US006234088B1

(12) United States Patent
Bredal et al.

(10) Patent No.: US 6,234,088 B1
(45) Date of Patent: May 22, 2001

(54) PALLET

(75) Inventors: Torben Bredal; Erik Sylvest, both of Gilleleje (DK)

(73) Assignee: Erik and Jens Sylvest, Roskilde (DK)

( * ) Notice: Subject to any disclaimer, the term of this patent is extended or adjusted under 35 U.S.C. 154(b) by 0 days.

(21) Appl. No.: 09/590,109

(22) Filed: Jun. 8, 2000

Related U.S. Application Data

(63) Continuation of application No. 09/101,745, filed as application No. PCT/DK96/00338 on Aug. 8, 1996, now abandoned.

(30) Foreign Application Priority Data

Jan. 15, 1996 (DK) ..... 0036/96

(51) Int. Cl.[7] ..... A47B 13/08
(52) U.S. Cl. ..... 108/91; 108/53.3
(58) Field of Search ..... 108/51.1, 53.3, 108/57.32, 91, 159, 161, 53.5, 53.1; 248/346.01, 346.02, 188.8; 297/239; 211/10, 11, 188

(56) References Cited

U.S. PATENT DOCUMENTS

| | | | | |
|---|---|---|---|---|
| 1,408,114 | * | 2/1922 | Mathieu | 108/91 |
| 1,508,898 | | 9/1924 | Smith . | |
| 1,527,141 | * | 2/1925 | Kirkpatrick et al. | 108/161 |
| 1,741,189 | | 12/1929 | Jencks . | |
| 2,256,750 | | 9/1941 | Riemenschneider . | |
| 2,924,830 | * | 2/1960 | De Long | 108/91 |
| 4,779,541 | * | 10/1988 | Milward | 108/91 |
| 5,564,345 | * | 10/1996 | Crawford et al. | 108/91 |
| 5,749,555 | * | 5/1998 | Albrecht | 108/53.3 |

* cited by examiner

*Primary Examiner*—Peter M. Cuomo
*Assistant Examiner*—Jerry A. Anderson
(74) *Attorney, Agent, or Firm*—Darby & Darby

(57) ABSTRACT

The invention relates to a single sheet pallet comprising an upwards facing loadbearing surface, the loadbearing surface having four side edges which two by two are essentially mutually parallel, four legs each of which is arranged at a respective corner of the loadbearing surface and extending downwards from this, and side flanges extending downwards from each of the four side edges. The invention further relates to an assembly comprising four such pallets, each pallet covering an area corresponding to one fourth of a standardized pallet, and further comprising a support element having a central cutout for one leg of each of the four pallets, and along the circumferential edge cutouts for the remaining three legs of each pallet, and means for connecting the support element to the pallets.

10 Claims, 7 Drawing Sheets

PALLET

This is a continuation of application Ser. No. 09/101,745, filed Jul. 10, 1998, which is a U.S. National Phase Application corresponding to Ser. No. PCT/DK96/00338 filed Aug. 8, 1996 now abandoned. Each of these prior applications is hereby incorporated herein by reference, in its entirety.

FIELD OF THE INVENTION

The invention relates to a single sheet pallet comprising an upwards facing loadbearing surface, the loadbearing surface having four side edges which two by two are essentially mutually parallel, four legs of which is arranged at a respective corner of the loadbearing surface and extending downwards from this.

BACKGROUND OF THE INVENTION

Various types of pallets are known within the area of transportation, storage and presentation of different goods.

From U.S. Pat. No. 1,508,898 a pallet of the above-mentioned type is known. In this previously known construction edge portions at two apposite sides are bent downwards to form a side portion comprising legs. In order to provide a sufficient strength and rigidity of this construction it is necessary to manufacture the pallet from a sheet material having a considerable thickness, which influences the weight and, moreover, the costs of both manufacturing and transportation.

A similar construction is known from U.S. Pat. No. 1,741,189. The problem relating to the strength and rigidity of the construction is realized in this later publication. In order to provide a sufficient rigidity, separate support elements are arranged between the top part and each side part of the pallet. This is a time and cost consuming operation.

Both these previously known pallets are obviously not constructed for stacking as the sides and legs extend downwards in a vertical manner.

Further previously known pallet constructions include wooden pallets and plastic material pallets.

The wooden pallets, e.g. the so-called EUR-pallets, are heavy and therefore difficult to handle. Moreover, the wooden material inherent provides numerous dead spaces where bacteria growth can take place. As the wooden pallet is difficult to clean it is not possible to use this in connection with food products. Such pallets occupy a considerable space when stacked.

The known plastic material pallets, like the wooden pallet, are difficult to clean due to constructions including ribs in the loadbearing surface and legs also being provided with internal ribs. Due to the internal ribs in the legs these pallets like the wooden pallets, occupy a considerable space when stacked.

The wooden and the plastic material pallets as known today are not considered relevant in relation to the single sheet pallets which under almost all circumstances provide for a high hygienic standard.

BRIEF DESCRIPTION OF THE INVENTION

The object of the present invention is to provide a single sheet pallet of the type mentioned in the introductory part of the description by which a sufficient rigidity is obtained with a reduced thickness of the sheet from which the pallet is manufactured.

According to the invention this object is obtained by a single sheet which further comprises side flanges extending downwards from each of the four side edges.

By providing sideflanges at all four sides of the pallet an improved rigidity is obtained in all load directions. This allows for the use of a reduced thickness of the material sheet used for manufacturing the pallet.

The rigidity of the construction is further increased when the legs at each side are connected to the adjacent flange. In this manner a continuous circumferential flange is formed on the pallet, the legs of the pallet forming parts of this flange.

The legs preferably have a non-linear cross section, e.g. an S-shaped cross section. Hereby an increased second moment of area is obtained for the legs resulting in an improved rigidity of the legs. Use of a reduced thickness manufacturing material is hereby possible.

The free edge portion of at least two, preferably all, side flanges at mutually parallel side edges are preferably bent inwards so as to be essentially parallel to the loadbearing surface. This feature allows for a better and more comfortable manual handling of the pallets. Moreover, the inwards bent edge portions provide a supporting surface towards pallet lifting and transporting equipment and a supporting surface for stacking of the pallet on a subjacent pallet.

The legs are preferably inclined downwards and outwards from the loadbearing surface in order to allow a stacking of several pallets. Hereby the angle of inclination preferably is so that the inwards bent edge portions of the side flanges of one pallet abut on the loadbearing surface of a second subjacent pallet without any contact between the legs of the two pallets. This means that the height of the side flange defines the minimum angle of inclination. This pallet construction allows for a compact stacking of pallets according to the invention. A pallet placed on top of a subjacent pallet will only add the height of the side flange to the total height of the stack.

A support part is preferably provided at the lower end of each leg.

In a preferred embodiment this support element is constituted by an outwards bent end portion of the leg.

The loadbearing surface of the pallet is preferably provided with corrugations or impressions in order to obtain a profile within an improved rigidity.

The pallet according to the invention is preferably manufactured with dimensions corresponding to a quarter of the area of the standardized pallet, e.g. a so-called EUR-pallet, which measures 1200×800 mm. Other standard pallet sizes are used in e.g. the USA or GB. The quater-pallet is used in e.g. supermarkets, in order to transport and present a limited amount of goods in the sales area.

This means that the quarter-pallet corresponding to the EUR-standard measures 600×400 mm. In this connection it is of particular importance that the projection of the pallet falls within these measures, hereby assuring that four of these pallets require the same area as a standardized full size pallet. Further it is required that the side edges of the pallet extend to the requested dimension. This means that the legs in order to extend downwards and outwards from the loadbearing surface must extend from an edge within the outer rectangular dimension. Hereby the lower part of the leg or the optional support part a the lower part of the leg still falls within the rectangular quater-pallet dimension.

Standard pallet lifting and transporting equipment requires a certain width between the legs of the pallet and a certain height to the support edge or surface to abut on the lifting and transporting equipment. By a quater-pallet the legs therefore are arranged at the shorter sides of the pallet bearing a sufficiently wide space at the longer sides to allow a lifting and transporting apparatus to be introduced under the pallet from this side.

A further object of the invention is to provide for a simple and efficient handling of the pallets according to the invention.

The invention therefore further relates to an assembly comprising four pallets according to the invention, each pallet covering an area corresponding to one fourth of a standardized pallet, the assembly further comprising a support element having a central cut-out for one leg of each of the four pallets, and along the circumferential edge cut-outs for the remaining three legs of each pallet, and means for connecting the support element to the pallets.

Hereby it is possible to handle an assembly comprising four pallets as a full size standardized pallet without arranging these pallets on a full size pallet. Hereby the one-piece full size pallet can be omitted and when necessary separate the pallets from each other by removing the support elements for subsequent individual handling of the pallets. The support element can be a metal or plastic material plate. Where the hygenic requirements are lower a wooden plate element, e.g. a plywood plate element, can be used. Such plate element my at the circumferential edge be reinforced by means of a metal band fastened to the element.

In order to allow the assembly to be transported on conveyor systems comprising rollers the assembly may further comprise at least two support rails, each arranged under one row of legs, hereby constituting continuous support planes abutting the rollers.

BRIEF DESCRIPTION OF THE DRAWINGS

In the following a preferred embodiment of the pallet according to the invention will be described more detailed with reference to the drawings, wherein.

DETAILED DESCRIPTION OF THE INVENTION

Figure 1:
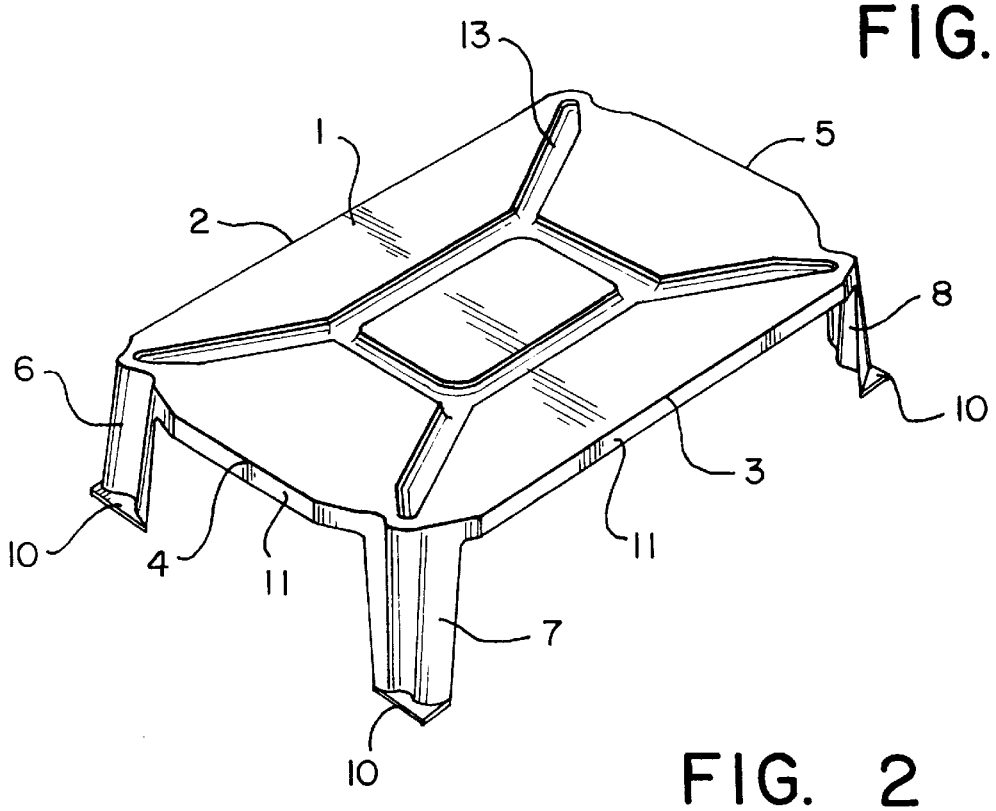
FIG. 1 is a perspective view of a pallet.

From FIG. 1 it appears that the preferred embodiment of the pallet according to the invention comprises a loadbearing upwards facing surface 1. The loadbearing surface 1 has four side edges 2, 3; 4, 5 which two by two are mutually parallel. At respective corners of the loadbearing surface 1 legs 6, 7 8, 9 extend downwards and outwards from the loadbearing surface. The lower free end portion of each leg forms a support portion 10. From each side edge 2, 3; 4, 5 a side flange 11 extends downwards, and provides an improved rigidity on the construction. In the loadbearing surface an impression 13 has been provided. The impression comprises a central essentially rectangular part and rectininear parts which extend from the corners of this rectilinear part towards the corners of the pallet.

Figure 2:
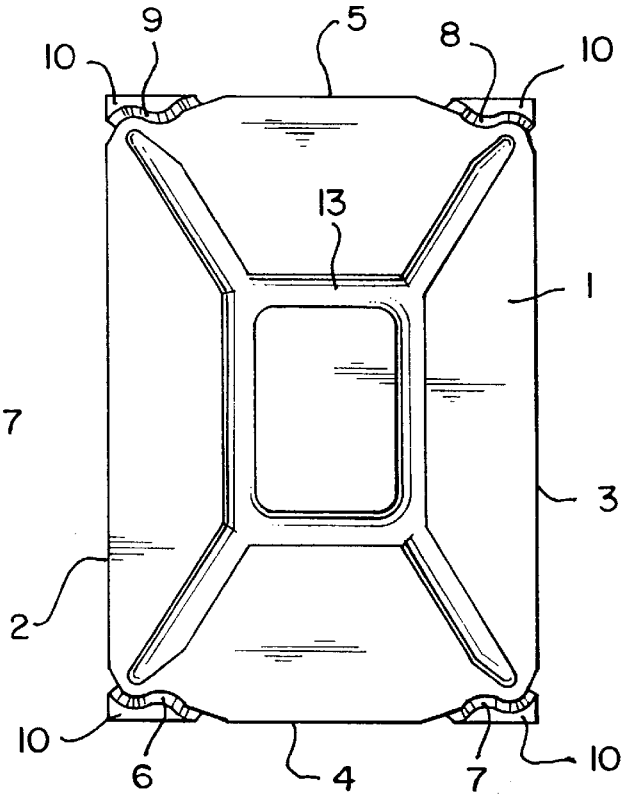
FIG. 2 is a top view of the pallet shown in FIG. 1.
Figure 7:
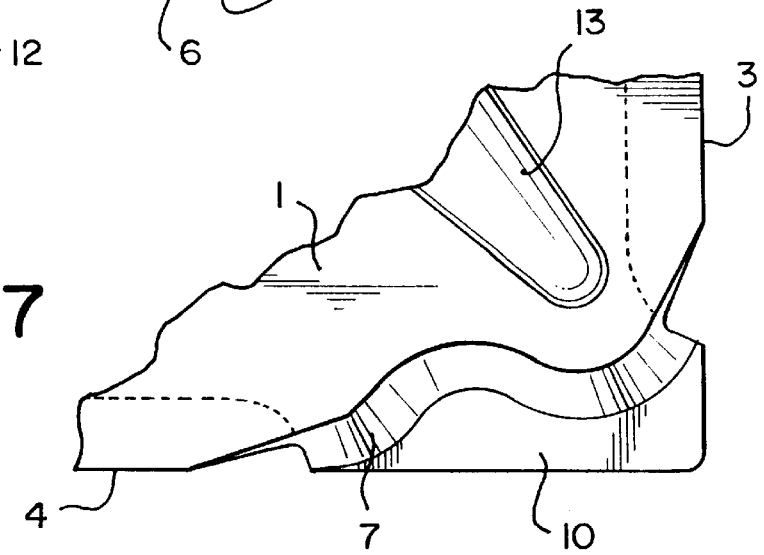
FIG. 7 is an enlarged top view of a corner area of a pallet.
Figure 6:
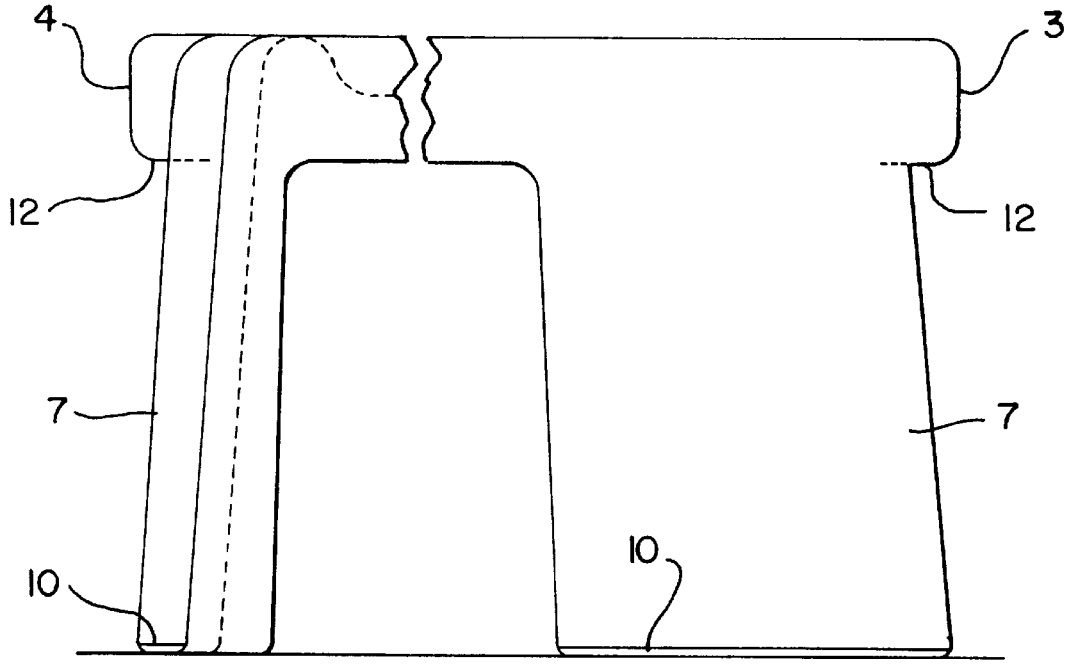
FIG. 6 is an enlarged side and end view of a corner area of a pallet.

From FIGS. 2 and 7 it appears more clearly that the legs in cross section are double curved, e.g. are formed with an S-shape. In this context the wording "double curved" is to be understood as being convex or concave seen from both sides. From FIG. 7 it appears that the leg 7 extends downwards from the loadbearing surface along a curved line which innermost limitations are indicated by a dotted line 16. Since the construction due to the load imparted thereon in this area will be influenced by considerable forces it is of importance that the impression 13 extends beyond this imaginary line in order to provide an improved rigidity of the construction in this area.

Figure 4:
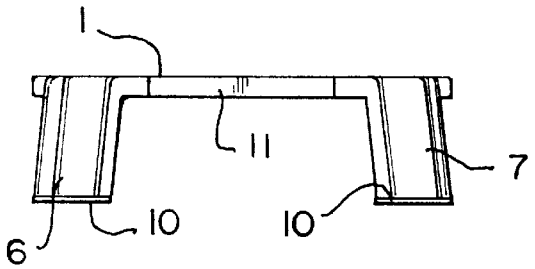
FIG. 4 is an end view of the pallet shown in FIGS. 1 through 3.
Figure 3:
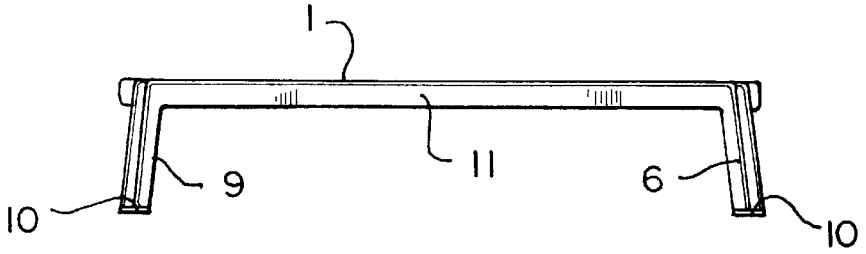
FIG. 3 is a side view of the pallet shown in FIGS. 1 and 2.

FIGS. 3 and 4 show the pallet seen from the side and the end, respectively.

Figure 5:
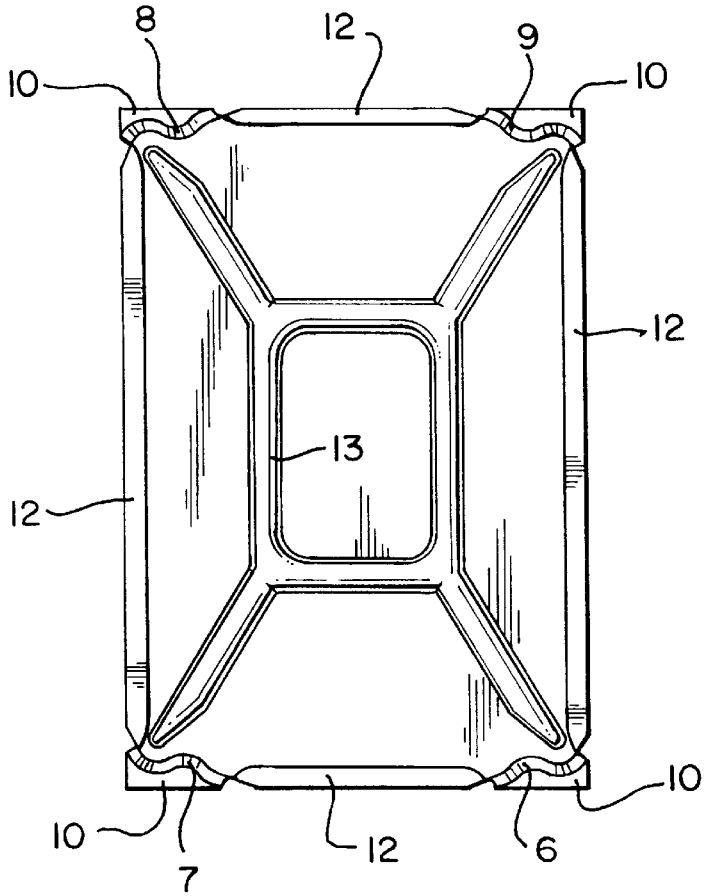
FIG. 5 is a bottom view of the pallet shown in FIGS. 1 through 4.

From FIG. 5, which shows the pallet seen from below, the inwardly bent edge portions of the side flanges appear. As previously explained, these edge portions provide for an improved manual handling and moreover serve as support portions when a pallet is lifted and transported by means of a transporting device.

Figure 8:
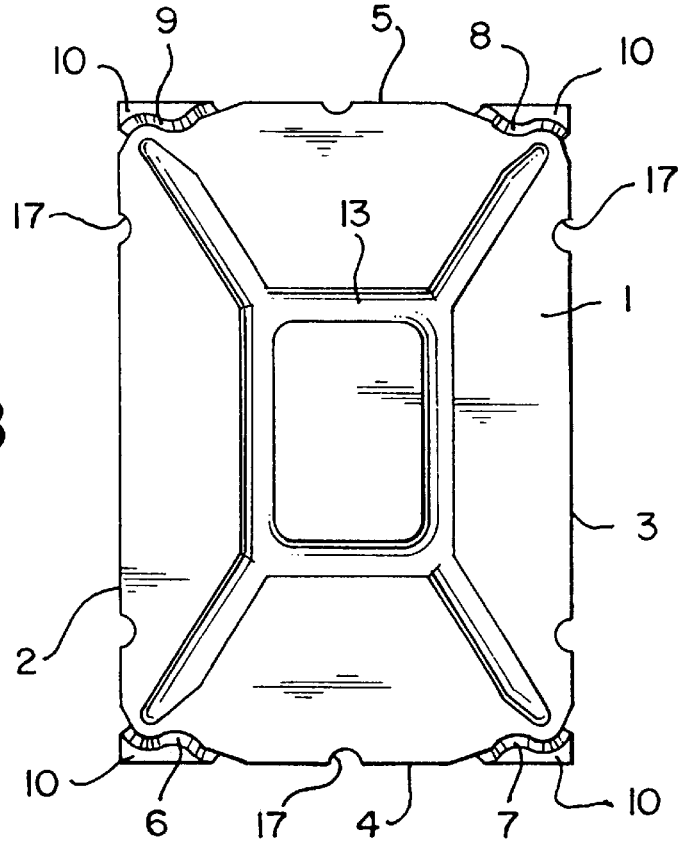
FIG. 8 shows an embodiment with enhanced side flange rigidity.

FIG. 8 shows a modified pallet where impression 17 has been made in the side flange 11 and at the same time in the loadbearing surface 1 and the inwardly bent portion 12, in order to improve the rigidity of the side flange in the transversal direction towards and away from the opposed side flange. However, the impression does not necessarily include an impression in the loadbearing surface or the indwardly bent portion as a sufficient rigidity can be obtained by making an impression in the side flange and either the loadbearing surface or the inwardly bent portion. The impression can in this case be partly spherical.

Figure 9:
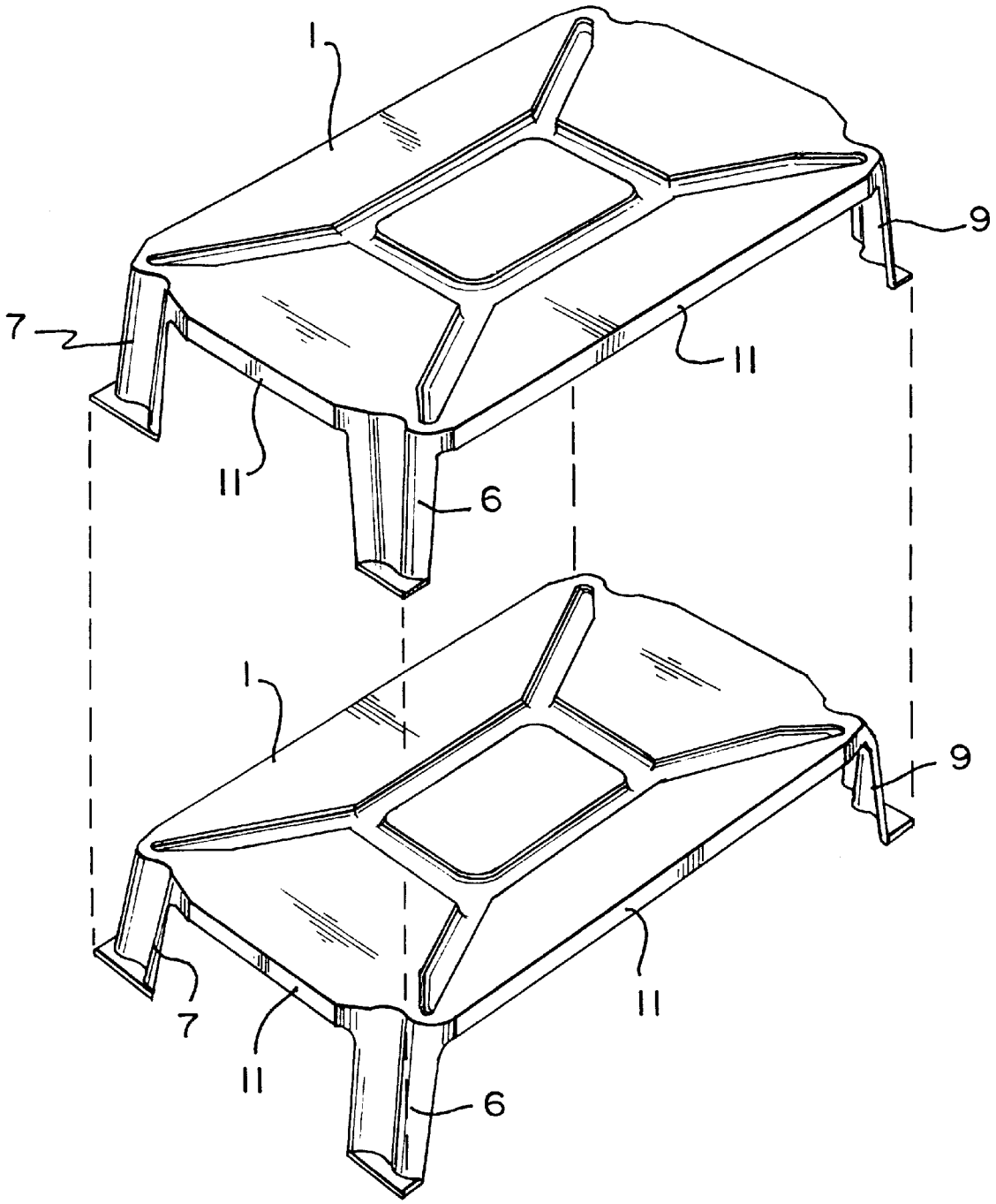
FIG. 9 shows two pallets immediately before stacking.
Figure 10:
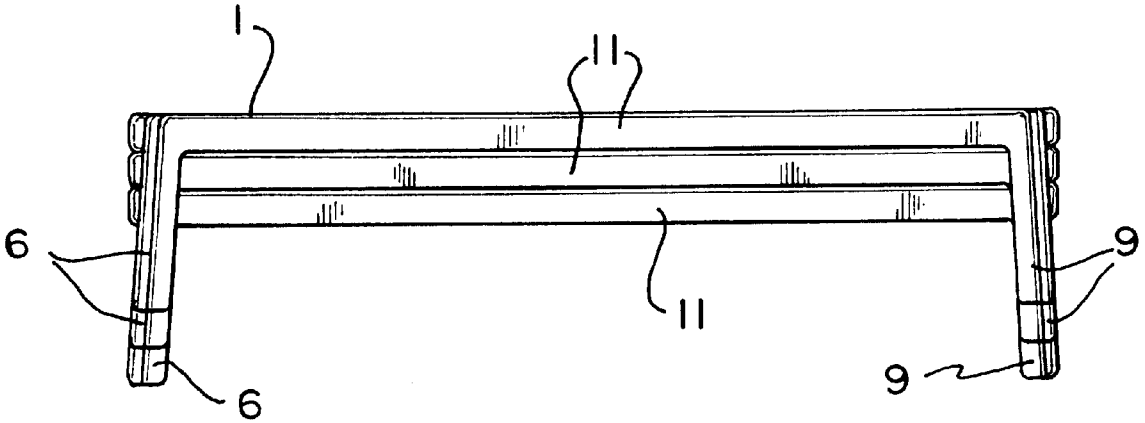
FIG. 10 is a side view of three stacked pallets.

FIG. 9 shows two pallets immediately before a stacking. FIG. 10 shows three stacked pallets. It is clear that a pallet placed on top of a subjacent pallet only adds the height of its side flange to the total stack height.

Figure 11:
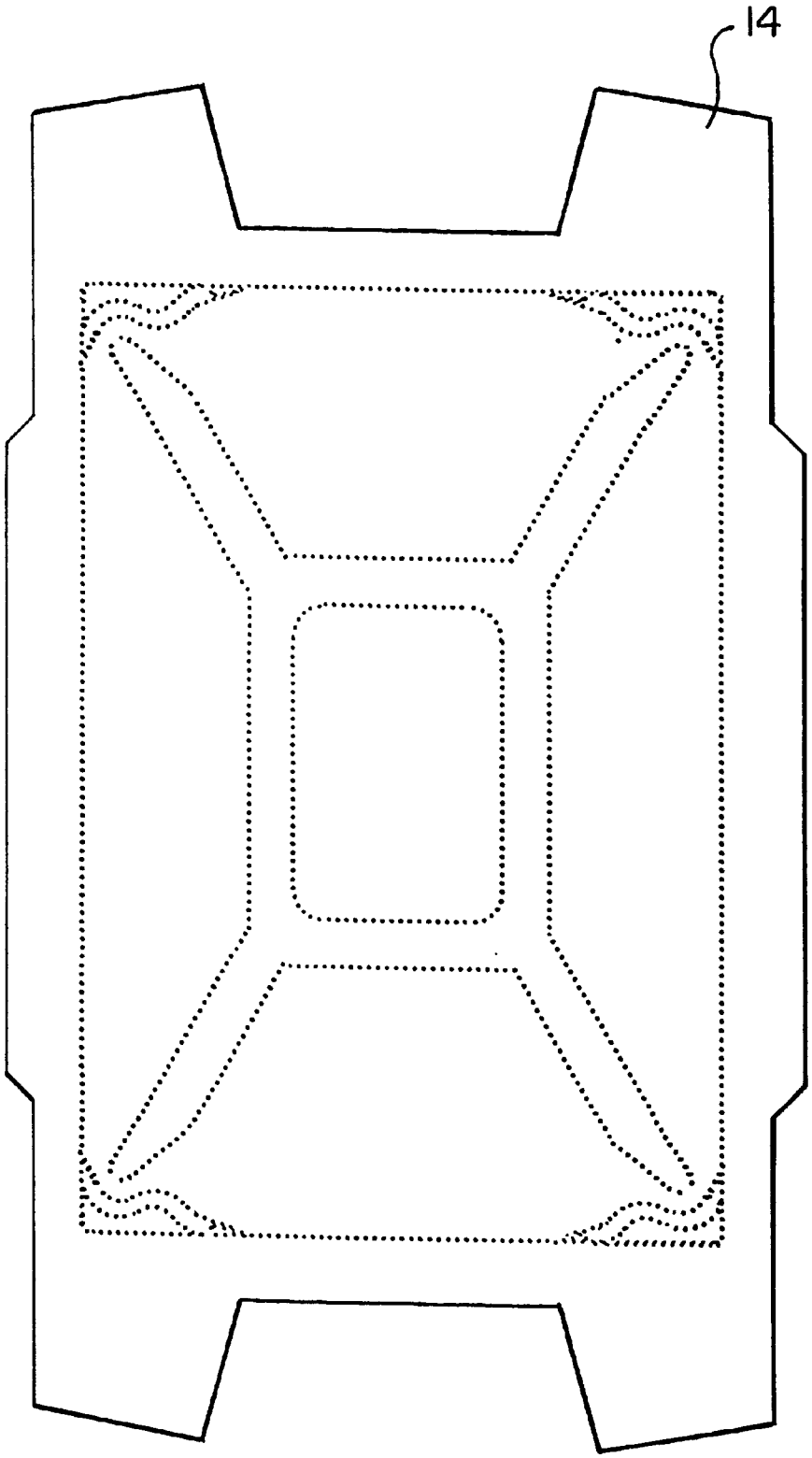
FIG. 11 is a tip view of a metal sheet for manufacturing a pallet.

FIG. 11 shows a sheet 14 for manufacturing a pallet according to the invention. The pallet is indicated in a topview by a dotted line.

Figure 13:
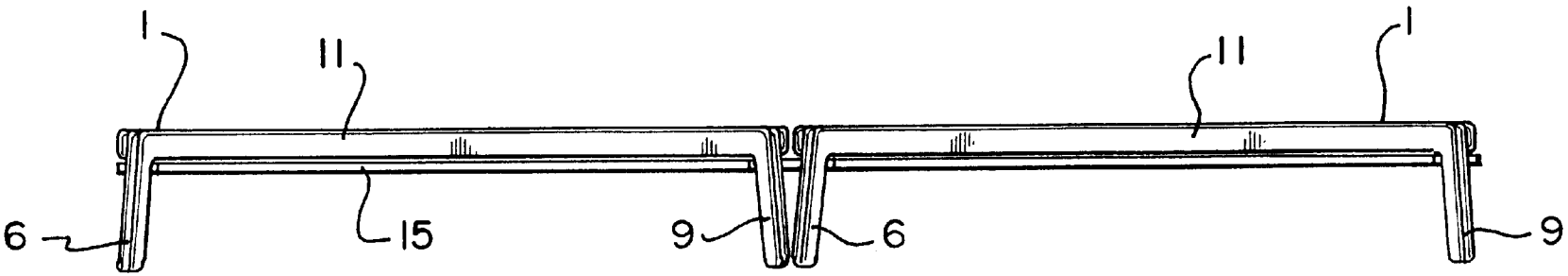
FIG. 13 is a side view of the assembly shown in FIG. 12.
Figure 12:
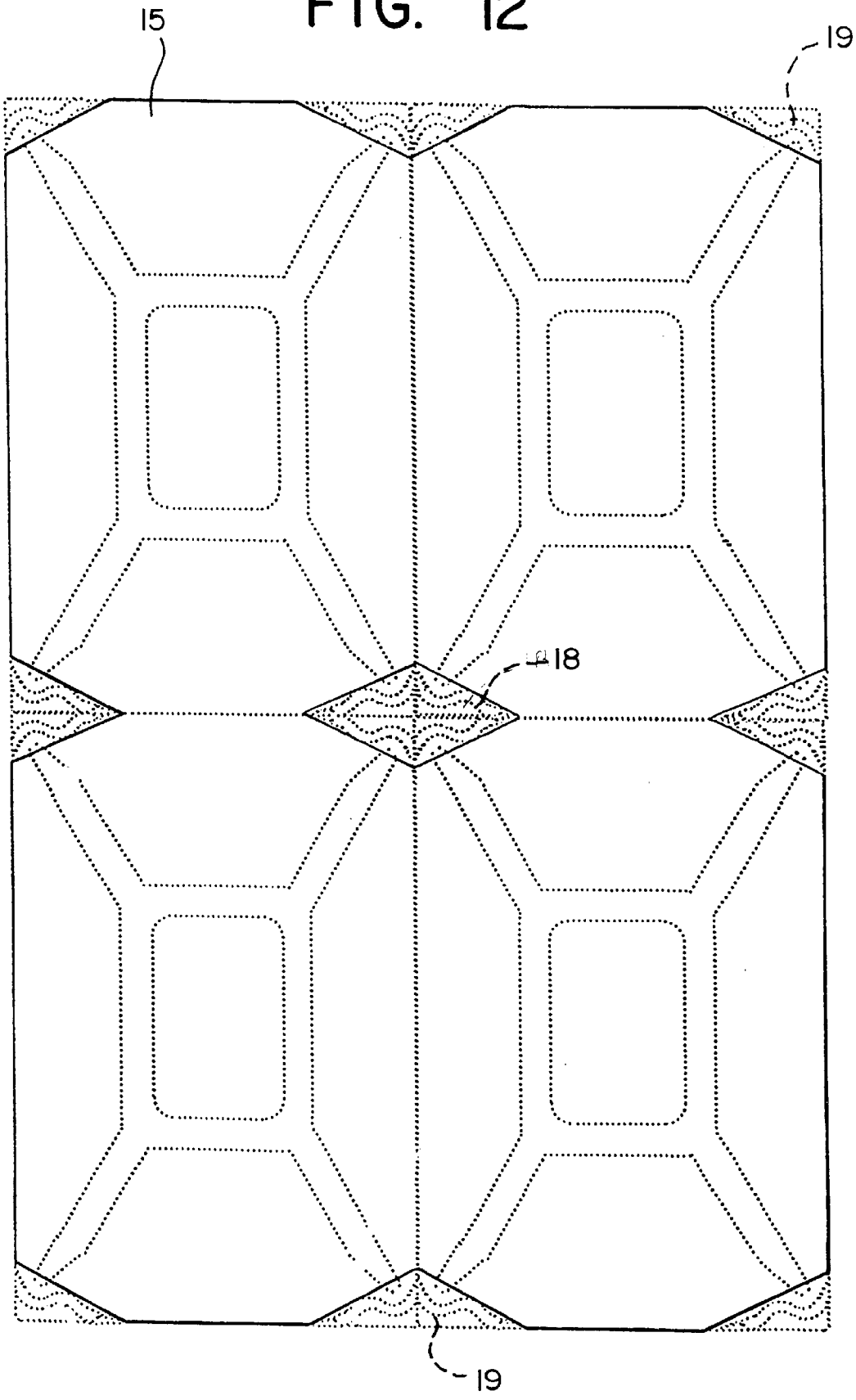
FIG. 12 shows an assembly comprising four pallets.

FIG. 12 shows an assembly comprising four pallets according to the invention. The four pallets are for the sake of clarity indicated by dotted lines. The side edges abut opposed side edges of adjacent pallet hereby providing a continuous loadbearing surface only interrupted in the leg area. A support element 15 in the form of a plate 15, having a central cutout 18 and further cutouts 19 along the circumference. From FIG. 13 it appears that the support element 15 abuts the inwardly bent lower portion of the side flanges. The support element is secured by connecting means, e.g. a strap.

What is claimed is:

1. A pallet comprising:

a single of material, which sheet is formed with an upwardly facing load bearing surface having four corners and four side edges, said side edges being two by two mutually parallel;

an extension at each corner of the load bearing surface extending downwards from the load bearing surface to form pallet legs, said legs having a non-linear cross-section with concave and convex portions seen from both sides of the sheet; and further extensions along the four side edges forming downwardly extending side flanges, each said leg being connected to said further extensions at adjacent sides.

2. A pallet according to claim 1, wherein the extensions forming the legs have an S-shaped cross section.

3. A pallet according to claim 1 wherein the free edge portion of each of said side flanges is bent inwardly to be substantially parallel to said load bearing surface.

4. A pallet according to claim 1, wherein each extension forming a pallet leg is terminated at its lower end by a flange part extending parallel to said load bearing surface and to form a support part for the leg.

5. A pallet according to claim 1 wherein each of said legs also extend outwards from said load bearing surface.

6. A pallet according to claim 1 wherein the load bearing surface comprises corrugations and/or impressions.

7. A pallet according to claim 6, wherein at least one corrugation or impression extends beyond a line between the outer upper corners of each leg.

8. A pallet according to claim 1 wherein said single sheet is one of a single sheet of formable material, preferably a metal sheet such as of a steel plate, an aluminum or aluminum alloy plate, or a composite material plate.

9. A pallet according to any one of claims 1 through 8, characterized in being manufactured from a single sheet of formable material, preferably a metal sheet, such as a steel plate, an aluminum or aluminum alloy plate, a composite material plate or the like.

10. A pallet according to claim 1 wherein the concave and convex portions of said legs are of equal size.

* * * * *